US006191763B1

(12) United States Patent
Salavin et al.

(10) Patent No.: US 6,191,763 B1
(45) Date of Patent: Feb. 20, 2001

(54) PROCESS FOR CONTROLLING A DISPLAY PANEL AND DISPLAY DEVICE USING THIS PROCESS

(75) Inventors: Serge Salavin, St Egreve; André Dunand, Voreppe, both of (FR)

(73) Assignee: Thomson-CSF, Paris (FR)

( * ) Notice: Under 35 U.S.C. 154(b), the term of this patent shall be extended for 0 days.

(21) Appl. No.: 09/117,181

(22) PCT Filed: Jan. 21, 1997

(86) PCT No.: PCT/FR97/00115

§ 371 Date: Jul. 29, 1998

§ 102(e) Date: Jul. 29, 1998

(87) PCT Pub. No.: WO97/28526

PCT Pub. Date: Aug. 7, 1997

(30) Foreign Application Priority Data

Jan. 30, 1996 (FR) ..... 96 01060

(51) Int. Cl.[7] ..... G09G 3/28
(52) U.S. Cl. ..... 345/68; 345/60
(58) Field of Search ..... 345/60, 68, 208, 345/210, 211, 58, 100

(56) References Cited

U.S. PATENT DOCUMENTS 4,650,434 3/1987 Deschamps et al. .
4,684,849 * 8/1987 Otsuka et al. ..... 345/68
5,030,888 7/1991 Salavin et al. .
5,066,890 11/1991 Salavin et al. .
5,075,597 12/1991 Salavin et al. .
5,086,257 2/1992 Gay et al. .
5,237,315 8/1993 Gay et al. .
5,247,288 * 9/1993 Warren et al. ..... 345/68
5,867,135 * 2/1999 Salavin et al. ..... 345/68

FOREIGN PATENT DOCUMENTS 0 337 833 10/1989 (EP) .
0 357 485 3/1990 (EP) .
2 704 674 11/1994 (FR) .

* cited by examiner

*Primary Examiner*—Kent Chang
(74) *Attorney, Agent, or Firm*—Oblon, Spivak, McClelland, Maier & Neustadt, P.C.

(57) ABSTRACT

A process for controlling a display panel having cells defined by the intersection of two networks of crossed electrodes. The cells have two states, one written and the other erased. A square-wave hold signal on either side of a middle potential is applied to all the cells to produce a hold discharge with regard to the cells in the written state, at the termination of the edges leading to an extreme porch. It also includes applying an addressing signal superimposed on the hold signal in succession to the electrodes of a network. The addressing signal includes a semi-erase-selective signal generating, with regard to the cells linked to the selected electrode, an erase discharge at the termination of an edge leading to an extreme porch of the hold signal. This disables the whole discharge generated by the hold signal alone. This method is applicable to the control of plasma display panels.

20 Claims, 7 Drawing Sheets

PROCESS FOR CONTROLLING A DISPLAY PANEL AND DISPLAY DEVICE USING THIS PROCESS

The present invention relates to a process for controlling a memory-effect display panel, especially those of large size. Its purpose is to increase the image renewal rate.

DISCUSSION OF THE BACKGROUND

Recent developments in large-size plasma display panels or those for high-definition television have led to a larger resolution and to an ever faster image renewal rate.

Display panels comprise a large number of cells arranged in matrix form in lines and columns. Each cell consists of the gaseous space lying at the intersection of two electrodes belonging to two orthogonal networks of electrodes and is subjected to control signals consisting of the difference of the voltages applied to the two electrodes between which it lies.

The principle of operation of memory-effect panels is generally as follows. A substantially square-wave AC hold signal is applied to all the lines. Its effect is to maintain each cell in the state which was assigned to it previously by an addressing signal. It generates a hold discharge with regard to the cells in the written state.

Addressing is generally carried out by line-by-line scanning. All the cells of a selected line are controlled simultaneously by a more or less complex semi-selective operation so as to be "erased" and this operation is followed by a selective operation during which cells of the line may be "written". The semi-selective operation followed by the selective operation is accomplished with a time offset from one line to the next.

To obtain $2^a$ half-tones, the screen must be scanned a times over the duration T of a complete image. If n is the number of lines of the screen and t the duration for which a line is addressed, the following condition holds:

$$n.t.a \leqq T$$

For example, in a high-definition television type panel operating at 50 Hz with 8 half-tone levels and 1000 lines:

$$T = 20 \text{ ms}$$

$$t \approx \frac{20}{8 \times 1000} \approx 25\ \mu s$$

This duration is close to the physical limits of the duration required to produce a discharge.

If the number of lines and/or the number of half-tones must increase further, a saving in the addressing time becomes paramount in order to satisfy this increase in the image renewal rate.

In a plasma display panel, of AC type, the discharge current is limited by a capacitor in series with each cell so as to avoid destroying the display panel if the power supply is not limited in terms of current. This capacitor is generally produced by covering the electrode network with a dielectric layer of enamel for example.

The erasing of a cell consists in eliminating the charges stored on the dielectric at the cells of the relevant line.

To achieve erasure, a voltage is generally applied to the electrode forming the corresponding line and this causes a discharge whose intensity is chosen in such a way that the charges stored facing one another recombine so as to cancel one another out. The erasing of a cell creates a discharge current whose intensity is substantially equal to half that of the hold current since roughly half of the customary hold charges are transferred.

At the present, the semi-selective erase operation is performed in various ways.

The hold signals are generally a succession of voltage square-waves, between two extreme porches, high and low, possibly with a middle porch. The semi-selective erase address signal has the shape of a voltage pulse, of amplitude suitable to create an erase discharge, which is superimposed on the square-waves of the hold signal. This semi-selective erase addressing signal will actually increase the duration of a hold cycle as compared with that required to effect just the holding.

FIGS. 1*a*, 1*b*, 1*c* show timing diagrams of the hold signal and of the semi-selective erase addressing signal in various cases used at present. The selective write addressing signal is no. represented.

In FIG. 1*a*, the hold signal Vref (represented as a solid line) comprises two extreme porches, one corresponding to the low potential V1 (negative) and the other to the high potential V2 (positive), these porches being established on either side of a middle potential or reference potential V0 which is often the potential of earth. This hold signal Vref generates discharges with regard to the cells in the written state just after a reversal of polarity, that is to say after an edge leading to an extreme porch. The semi-selective erase addressing signal is a voltage pulse represented as a dashed line, superimposed on the hold signal. The erase pulse is generated during a low porch. The duration of the hold cycle is then equal to:

$$tca = tb1a + tma + tb2a + tha$$

with:

tb1a the duration of the low porch before the erase pulse, tma the duration of the erase pulse, tb2a the duration of the low porch after the erase pulse, tha the duration of the high porch.

In FIG. 1*b*, the hold signal Vref comprises a middle porch of duration tmb lying between two low porches of duration tb1b, tb2b.

The semi-selective erase addressing signal is a pulse superimposed on the hold signal Vref, and generated during this middle porch. Its amplitude Vpb is less than that Vpa represented in FIG. 1*a*.

The duration tcb of the hold cycle is then equal to:

$$tcb = tb1b + tmb + tb2b + thb$$

In FIG. 1*c*, the hold signal Vref comprises a middle porch of duration tcm between a low porch of duration tbc and a high porch of duration thc. The semi-selective erase addressing signal is a pulse of amplitude Vpc generated from this middle porch. The amplitude Vpc is less than that of FIG. 1*a*.

The duration tcc of the hold cycle is then equal to:

$$tcc = tbc + tmc + thc$$

The drawback of this type of operation is that the duration of the hold cycle is longer than that which is normally sufficient to effect holding. In the cases represented in FIGS. 1*a*, 1*b*, 1*c* this duration is increased by the duration tma, tmb, tmc respectively.

The configuration in which the erase pulse is generated from a middle porch has a drawback related to the presence of the middle porch during the hold cycle. Charges may disappear during this middle porch, this disappearance causing a partial loss of the memory of the panel.

Moreover, the generation of the middle porch requires a specific circuit.

The configuration in which the erase pulse is generated from the low porch has a drawback. The amplitude of the pulse to be generated is still large and this pulse can only be generated by a relatively expensive specific circuit.

SUMMARY OF THE INVENTION

The present invention therefore proposes to incorporate the time for the semi-selective erase addressing into the hold cycle without thereby increasing its duration.

To do this, the present invention is a process for controlling a display panel comprising cells defined by the Intersection of two networks of crossed electrodes, these cells possessing two states, one written, the other erased. It consists in applying a substantially square-wave hold signal on either side of a middle potential to all the cells, with the aim of producing a hold discharge with regard to the cells in the written state at the termination of the edges leading to an extreme porch and in applying an addressing signal, superimposed on the hold signal, in succession to the electrodes of a network. The addressing signal comprises a semi-selective erase signal which generates in respect of the cells in the written state an erase discharge.

The erase discharge occurs at the termination of an edge leading to an extreme porch of the hold signal. This erase discharge disables the hold discharge which should have been generated by the hold signal alone.

BRIEF DESCRIPTION OF THE DRAWINGS

The invention will be better understood on reading the description which follows of embodiments, given by way of non-limiting examples and illustrated by the appended figures which represent.

DETAILED DESCRIPTION OF THE PREFERRED EMBODIMENTS

Figure 1A:
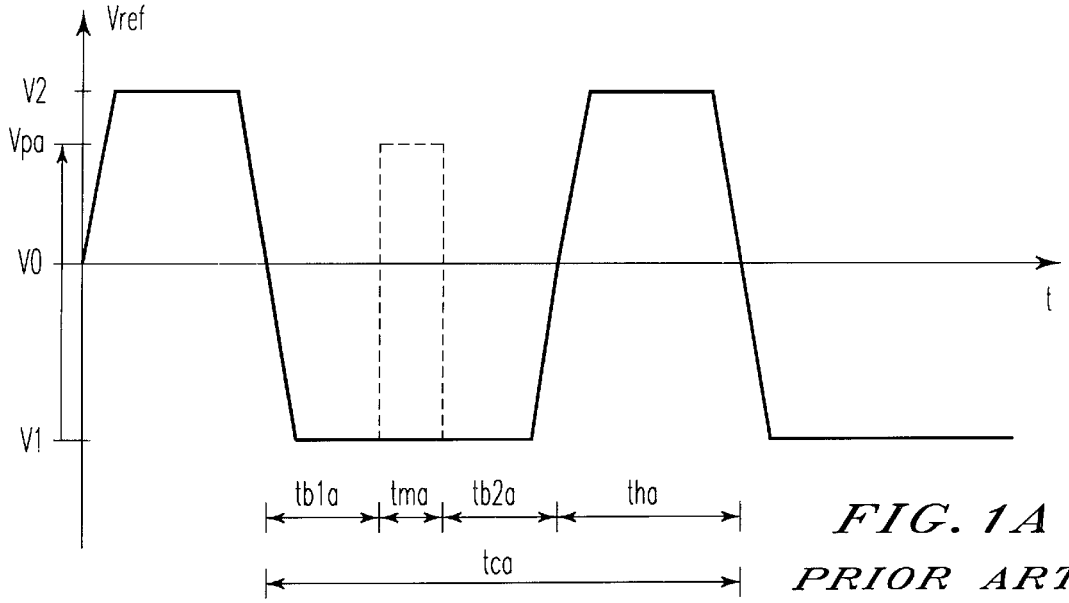
FIG. 1A PRIOR ART
FIGS. 1*a*, 1*b*, 1*c* (already described): timing diagrams of the hold and semi-selective erase addressing signals applied to a display panel controlled in the conventional manner.
Figure 1B:
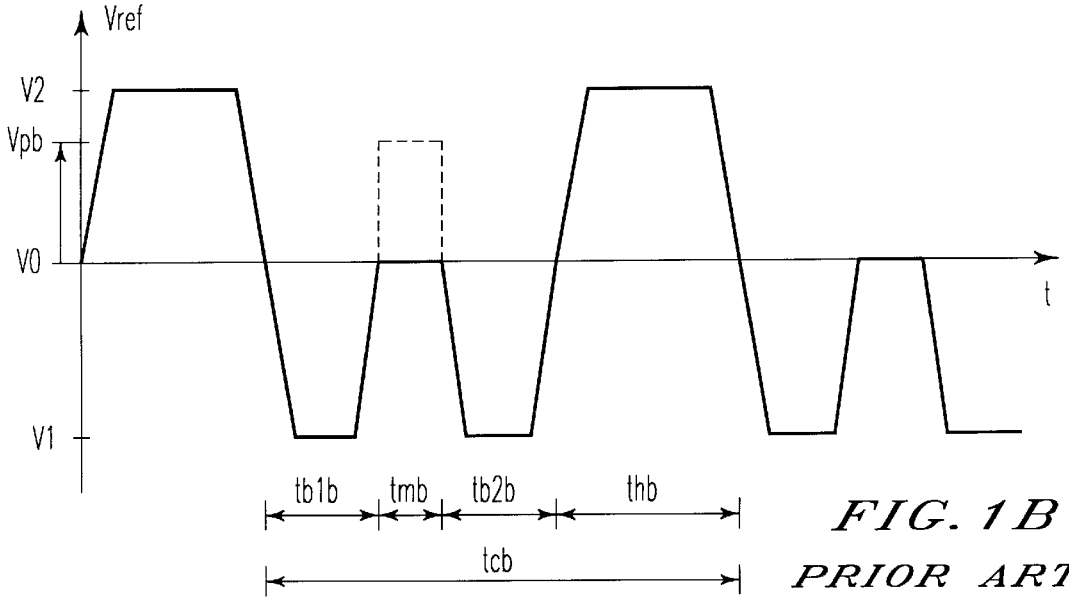
FIG. 1B PRIOR ART
Figure 1C:
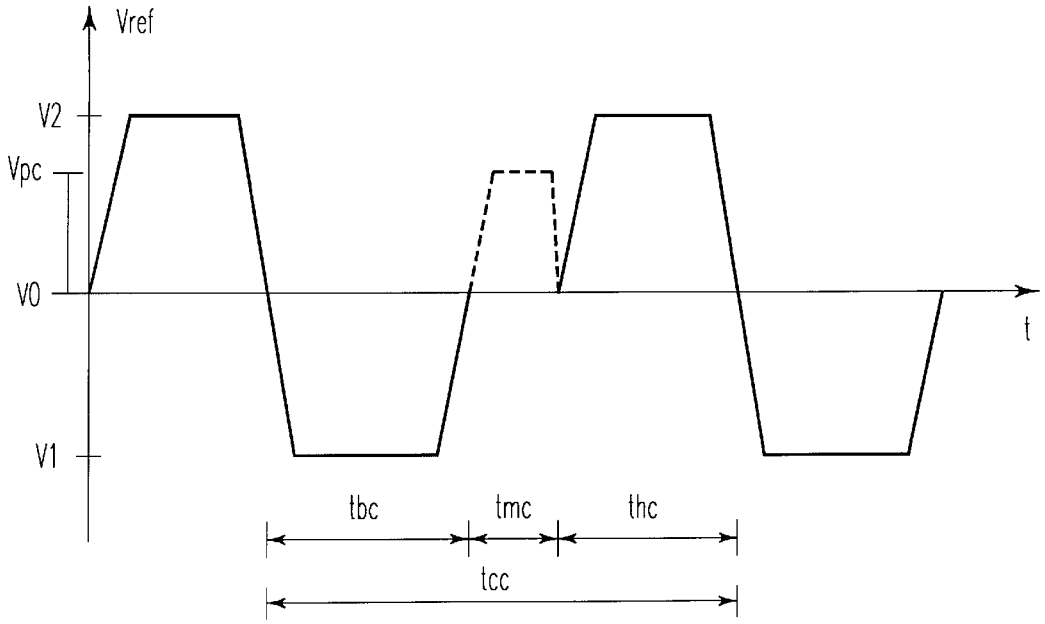
FIG. 1C PRIOR ART
Figure 2:
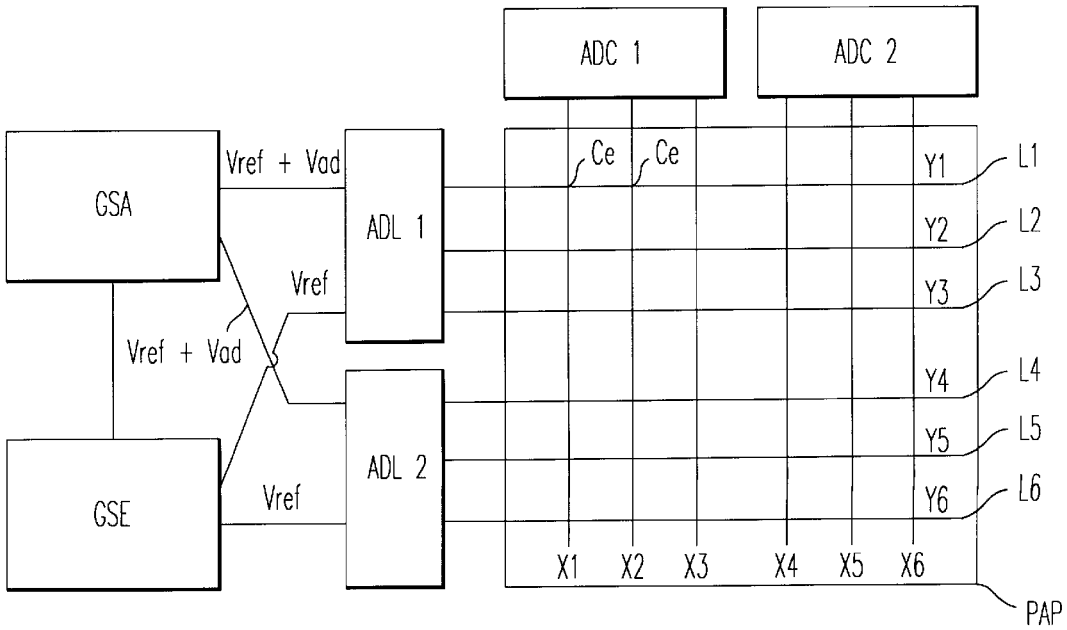
FIG. 2: a display device to which the process according to the invention is applied.

FIG. 2 represents diagrammatically an image display device to which the process according to the invention is applied. This display device comprises a plasma display panel PAP and control means.

The display panel PAP comprises a first network of line electrodes Y1 to Y4 crossed with a second network of column electrodes X1 to X4. Each crossing of electrodes corresponds to a cell Ce. The cells are arranged in matrix fashion. Each line electrode Yl to Y4 is linked to a line addressing circuit ADL1, ADL2 or "line driver".

In the case of large panels there are generally several of them. In the example represented there are two of them, each feeding a group of lines with hold and addressing signals.

Each column electrode X1 to X4 is linked to a column addressing circuit ADC1, ADC2 or "column driver". There are two of them in the example represented. The column addressing circuits generate pulses which mask those generated by the write-selective addressing signal on a selected line, with regard to the cells Ce of this line which are not to be written.

The line addressing circuits ADL1, ADL2 receive the hold signal Vref from a hold signal generator GSE and the addressing signal Vad superimposed on the hold signal Vref from an addressing signal generator GSA.

Figure 3A:
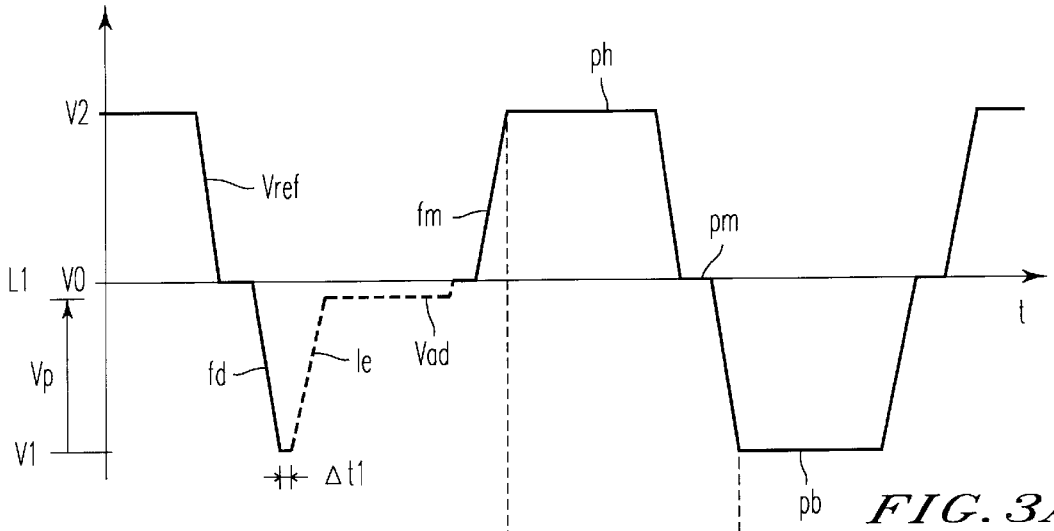
FIGS. 3*a*, 3*c*: timing diagrams of the hold and semi-selective erase addressing signals applied to two lines of a display panel controlled by the process of the invention.
Figure 3B:
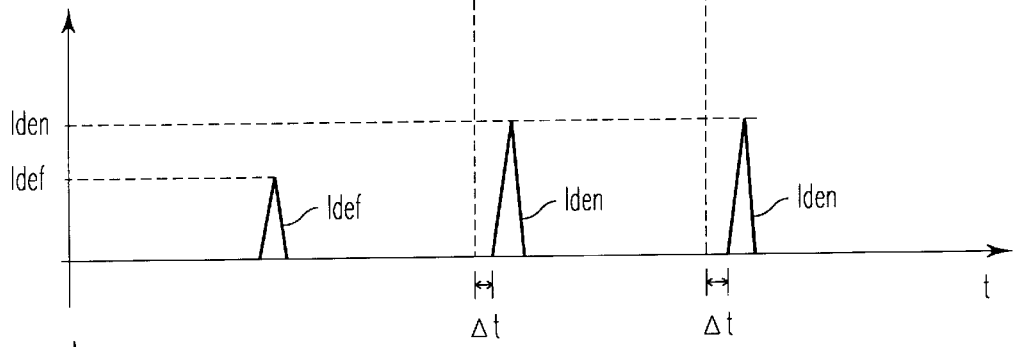
FIG. 3*b*: a timing diagram of the discharge currents appearing on the line receiving the signals of FIG. 3*a,*
Figure 3C:
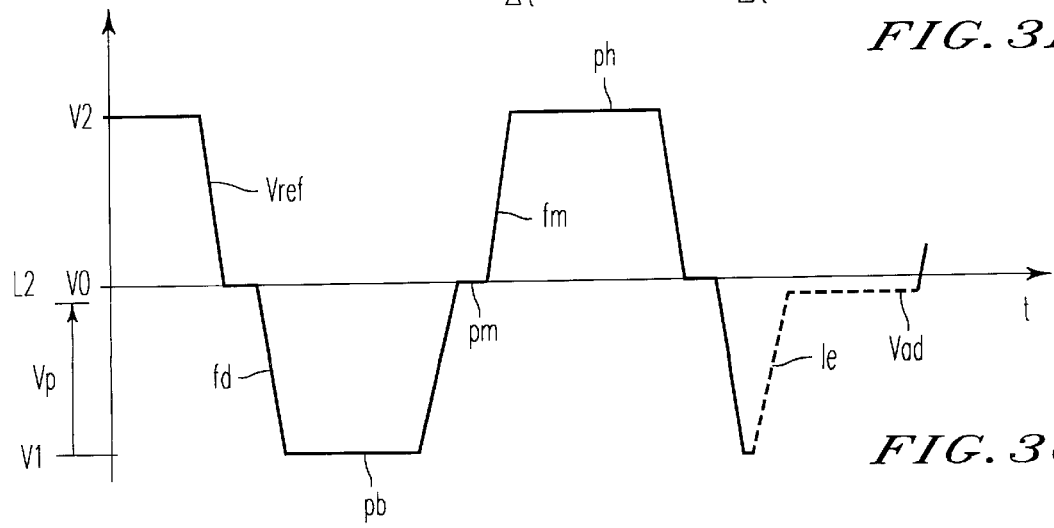

FIGS. 3*a*, 3*c* show a timing diagram of the signals received by two lines of the panel PAP of FIG. 2, selected in succession and referenced I1, I2. The panel PAP is controlled by the process according to the invention. FIG. 3*b* is a timing diagram of the discharges occurring on the line I1.

All the electrodes of a network, here all the line electrodes, simultaneously receive the hold signal Vref (represented as a solid line). This signal Vref is substantially square-wave, with extreme porches, high Ph at the potential V2 and low Pb at the potential V1, lying on either side of middle porches Pm, at the middle potential V0. The duration of the middle porches is relatively short. The middle porches Pm may be absent from the hold signal Vref. The extreme porches Ph, Pb are separated by rising fm and falling fd edges. The hold signal Vref causes hold discharges Iden with regard to the cells Ce in the written state. These discharges Iden occur after an interval of time Δt following the start of an extreme porch Ph, Pb. In colour plasma display panels, the time interval Δt is equal to a few hundred nanoseconds.

According to the process in accordance with the invention, the addressing signal Vad (represented as a dashed line) superimposed on the hold signal Vref is applied in turn to each of the electrodes of a network. In the example, it is applied to the line electrodes. It would be conceivable to apply it to the column electrodes. The hold signal Vref could also be applied to the column electrodes.

The addressing signal Vad is made up of a semi-selective erase signal and a selective write signal which does not interest us for the moment. The semi-selective erase addressing signal is an erase pulse Ie of amplitude Vp generated subsequent to an extreme porch Pb, Ph of the hold signal Vref after an interval of time Δt1 following the start of the extreme porch Pb, Ph. This time interval is such that:

$$0<\Delta t1<\Delta t$$

In FIGS. 3, the pulse Ie of the addressing signal Vad is generated subsequent to an extreme low porch Pb of the hold signal Vref.

The erase pulse Ie generates an erase discharge Idef with regard to all the cells Ce of the selected line in the written state and this discharge Idef disables that Iden which should have been generated by the hold signal Vref alone. The erase pulse Ie can last up to the following rising edge fm of the hold signal Vref or be shorter.

The values of the time interval Δt1 and of the amplitude Vp of the erase pulse are chosen so that the charges stored facing one another on the dielectric covering the electrodes of the cells Ce in the written state of the selected line leave their support and recombine in the gas space. The amplitude Vp represented is substantially equal to half that of the hold signal Vref.

Instead of the erase pulse Ie being generated subsequent to an extreme low porch Pb, it can be generated subsequent to an extreme high porch Ph. In both cases it possesses a porch which is closer to the middle potential V0 than are the extreme porches Ph, Pb of the hold signal Vref.

In FIG. 3*a*, an erase pulse Ie is generated subsequent to the first low porch Pb of the hold signal Vref whereas in FIG. 3*c* it is generated subsequent to the following low porch Pb. The selective write addressing signal can occur, in the conventional manner, for a line selected subsequent to the high porch Ph following that during which the semi-selective erase signal has taken place.

Figure 4A:
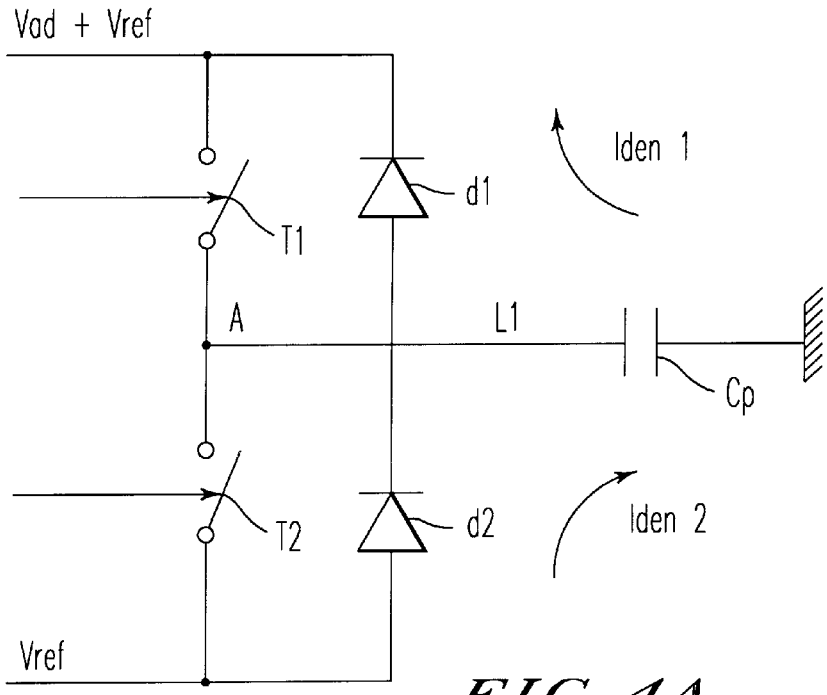
FIGS. 4*a*, 4*b*: the directions of the discharge currents flowing in an output stage module of an addressing circuit to which a conventional control process and the process according to the invention are applied.
Figure 4B:
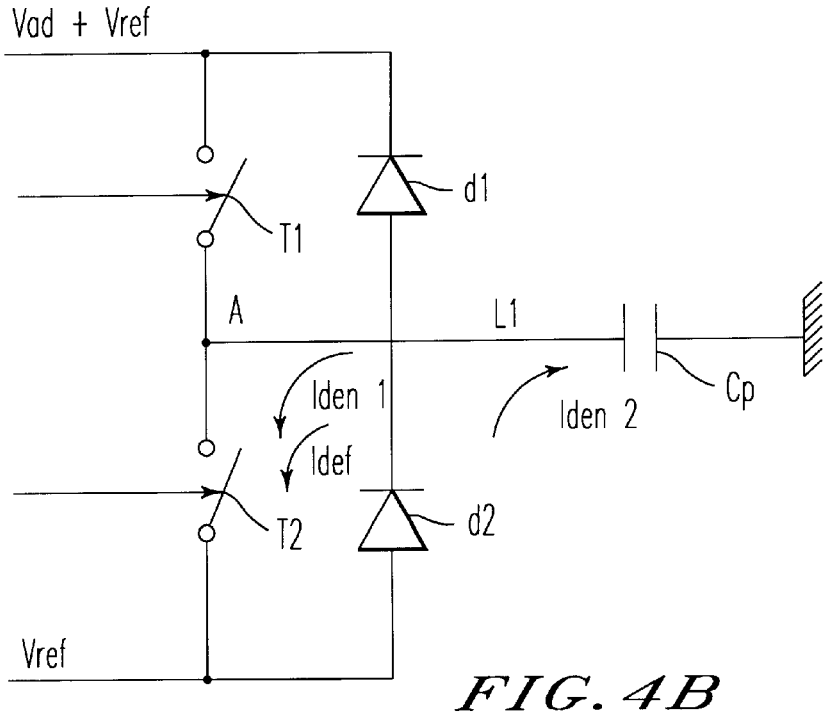

FIG. 4*a* represents diagrammatically an output stage module of a line addressing circuit ADL as well as the directions of the currents which pass through it when the display panel to which it is connected is controlled in the conventional manner. FIG. 4*b* represents the same module to which the process according to the invention is applied.

The line addressing circuit ADL which generally feeds several lines, possesses an output stage comprising as many modules, like that of FIG. 4, as lines.

Each module comprises a pair of switches T1, T2 having a common point A which is linked to the line electrode of the corresponding line I1. The line is electrically equivalent to a capacitance Cp.

One of the switches T2 receives the hold signal Vref and the other T1 receives the addressing signal Vad superimposed on the hold signal Vref. The switches T1, T2 are generally MOS transistors. They are switched alternately. When the signal Vref is applied the switch T1 is off and the switch T2 on, and the reverse occurs when the signal Vad superimposed on the signal Vref is applied.

A diode d1 is mounted in parallel with the switch T1, a diode d2 with the switch T2. The cathode of the diode d2 and the anode of the diode d1 are linked to the common point A.

In the case of conventional control of erasure, the semi-selective erase addressing signal Vad superimposed on the hold signal is applied to a line selected during the instants in which the hold signal Vref alone does not generate any discharge on the other lines.

The discharge current Idenl generated by the hold signal Vref during an extreme low porch Pb passes through the diode d1 and the discharge current Iden2 generated during an extreme high porch Ph passes through the diode d2 (see FIG. 4*a*).

When the display panel is controlled by the process according to the invention, the semi-selective erase addressing signal Vad superimposed on the hold signal Vref is applied to a line selected while the hold signal Vref alone is generating hold discharges on the other lines controlled by the same line addressing circuit. The hold discharge current iden1 generated during an extreme low porch on the lines which are not selected in respect of the semi-selective erase addressing can no longer pass through the diode d1 on account of the presence at this instant of the addressing signal Vad superimposed on the hold signal Vref on the cathode of the diode d1.

The hold discharge current Iden1 flows through the switch T2 receiving the hold signal Vref alone and which is on. Accordingly, the switch T2 will be dimensioned so as to be able to carry this hold discharge current idenl (see FIG. 4*b*).

The hold discharge current Iden2 generated during an extreme high porch passes through the diode d2 as in FIG. 4*a*.

On account of the stray current which inevitably appears when the switches are switched, it is preferable to separate in time the switchings of the two switches T1, T2 of the pair so as to avoid a double-conduction current in the two switches.

At the level of the module feeding the line selected for erasure, the switch T2 is on and the switch T1 is off. The erase discharge current Idef passes through the switch T2 and is interrupted when the switch T1 is switched in order to raise the signal back to the middle porch (see FIG. 3*a*).

Figure 5A:
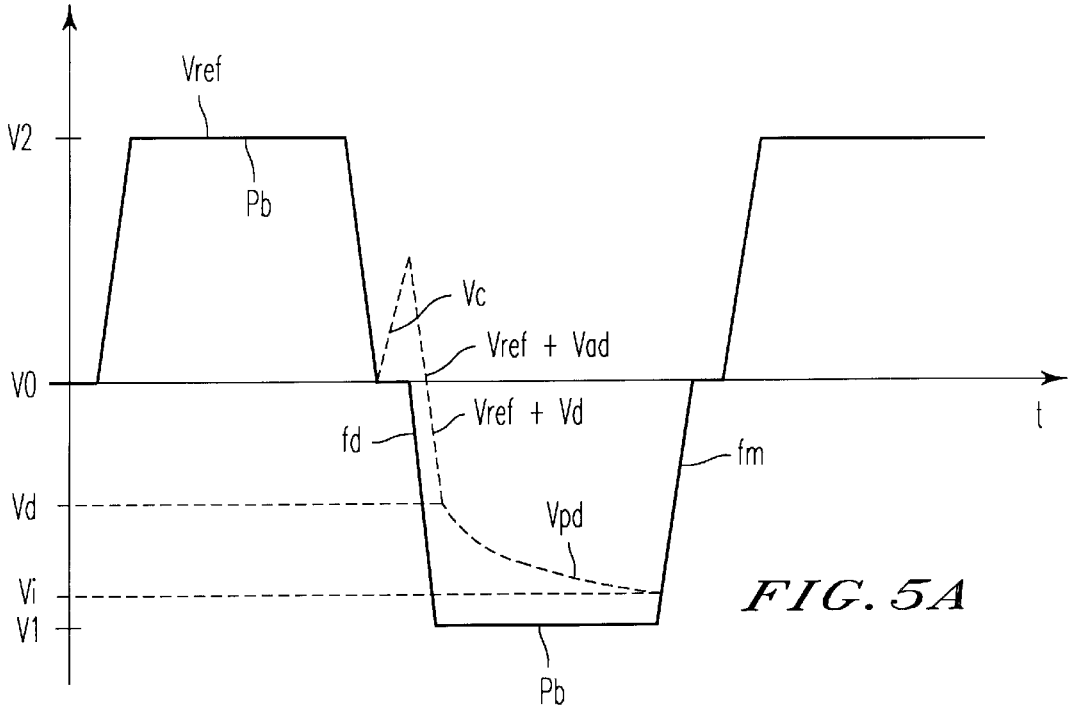
FIGS. 5*a*, 5*b*: timing diagrams of the hold and addressing signals applied to a line of a display panel controlled by two variants of the process according to the invention.

FIG. 5*a* represents a timing diagram of the hold signal Vref and of the semi-selective erase addressing signal Vad superimposed on the hold signal and applied to a selected electrode of a display panel controlled by a variant of the process according to the invention.

The semi-selective erase addressing signal Vad comprises a portion Vpd with decreasing slope, generated from an intermediate potential Vd referenced with respect to the potential V1 of the extreme porch and lying between the potential V1 and the middle potential V0 of the hold signal Vref, this portion Vpd ending at a residual potential Vi referenced with respect to the potential V1 lying between the said potential V1 and the intermediate potential Vd. The residual potential Vi can be zero. This portion Vpd with decreasing slope begins at the start of the said extreme porch. This signal portion Vpd with decreasing slope disables the hold discharge which should have been generated by the hold signal Vref in the absence of any semi-selective addressing signal Vad. This signal portion Vpd with decreasing slope produces an erase discharge with regard to the written cells of the selected line.

In FIG. 5*a*, the signal portion Vpd with decreasing slope starts at the same time as an extreme low porch of the hold signal Vref. The semi-selective erase addressing signal Vad comprises, ahead of the signal portion Vpd with decreasing slope, a portion which follows the hold signal Vref with the offset of Vd. The semi-selective erase addressing signal starts during the edge fd of the hold signal Vref which leads to the extreme low porch Pb during which the erase discharge will appear.

At the termination of the signal portion Vpd with decreasing slope, as the slope tends to zero, only the hold signal Vref is applied to the line which has just been erased. At the termination of the following rising edge of the hold signal Vref it is then possible to start the write-selective addressing in the conventional manner. This addressing is not represented in FIG. 5*a*.

The variation in the slope of the signal portion Vpd with decreasing slope can be adjusted so that the hold discharge which should occur in the absence of the addressing signal can indeed be stopped.

The use of the signal portion Vpd with decreasing slope allows the voltage triggering the erase discharge to be better adapted to all the display panel cells than in the variant represented in FIG. 3*a*. For, inevitably, a display panel is not homogeneous, that is to say the voltage which produces a discharge is not necessarily the same from one cell to another.

Figure 6A:
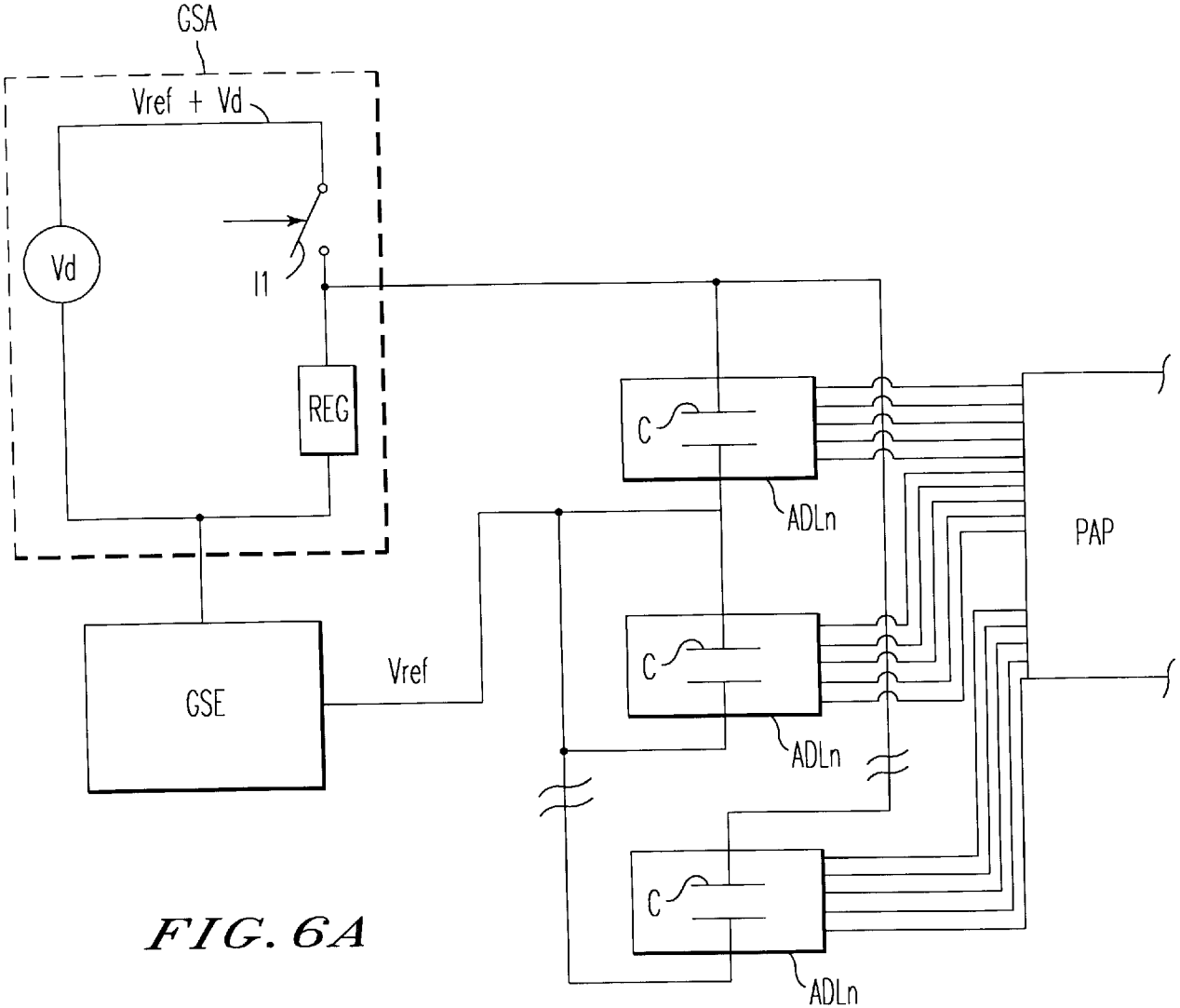
FIGS. 6*a*, 6*b*: display devices to which the variants of the process according to the invention are applied.

FIG. 6*a* shows diagrammatically an electronic circuit GSA making it possible to generate an addressing signal Vad superimposed on the hold signal Vref such as that represented in FIG. 5*a*.

This circuit comprises a voltage source Vd referenced with respect to the potential of the hold signal Vref. The hold signal Vraf is generated by a conventional hold signal generation circuit GSE. The output voltage from the voltage source Vd feeds all the line addressing circuits ADL1, ADL2, . . . ADLn of the panel PAP which moreover receive the hold signal Vref.

These line addressing circuits ADL1, ADL2, . . . ADLn are each electrically equivalent to a capacitance c. The capacitances c of the line addressing circuits ADL1, ADL2 are mounted in parallel. The addressing circuits ADL1, ADL2, . . . ADLn are each linked to several electrodes of the panel PAP.

A switch I1 is mounted between the output of the voltage source Vd and the line addressing circuits ADL1, ADL2, . . . ADLn.

The signal supplied by the voltage source Vd follows the hold signal Vref with an offset of Vd.

A current regulation device Reg is mounted in series with the switch I1, the assembly being mounted in parallel with the voltage source Vd. This device Reg can be embodied either as a potentiometer which makes it possible to adjust the time constant of the signal portion Vpd with decreasing slope, or as a current generator which allows adjustment of the slope.

The signal portion Vpd with decreasing slope is generated by discharging the capacitors c of the line addressing circuits ADL1, ADL2, . . . ADLn and this discharging is achieved by turning off the switch I1. The addressing signal Vad superimposed on the hold signal Vref applied to the selected line to be erased is then equal to:

$$Vref + Vd\frac{1}{\Sigma c}\int i dt$$

The capacitances c have to be charged beforehand. The charging is achieved by setting the switch I1 into the on state.

The charging of the capacitances c may occur at various times.

In the timing diagram of FIG. 5*a*, the charging of the capacitances c takes place during a falling edge fd of the hold signal.

Firstly, during this falling edge fd, all the lines receive the hold signal Vref. Next, the line selected for erasure will receive the semi-selective erase addressing signal Vad superimposed on the hold signal Vref. It is merely necessary to turn off the switch T2 of the module of the output stage linked to this line, to turn on the switch T1 and to turn on the switch I1 of the circuit GSA. The charging of the capacitances c begins. The idle time with regard to the switches T1, T2 of the pair is not necessary since switching is performed before the charging of the capacitances c has ended.

In FIG. 5*a*, the signal portion corresponding to the charging of the capacitances c bears the reference Vc. When charging has ended, the selected line receives the addressing signal Vad superimposed on the hold signal Vref, this being equal to Vref+Vd. It is offset by Vd with respect to the hold signal Vref.

The discharging of the capacitances starts when the hold signal Vref alone reaches the porch Pb.

As the slope of the signal portion Vpd with decreasing slope tends to zero, the line which has just been erased can again receive the hold signal Vref through the turning on of the switch T2 and the turning off of the switch T1 for example and/or settling of the residual potential Vi equal to V1.

It is also possible for the line which has just een erased to continue to receive the addressing signal Vad superimposed on the hold signal Vref, this corresponding to Vref+Vi.

Figure 5B:
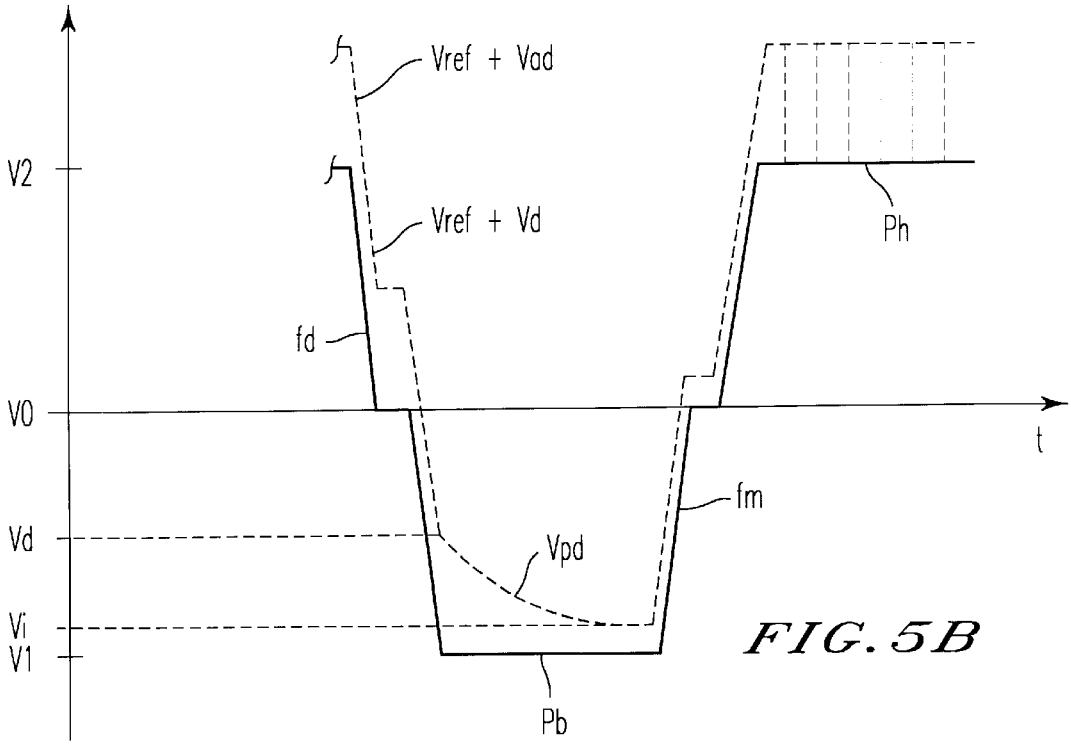

It is conceivable for the charging of the capacitances c to take place during an extreme porch of the hold signal Vref instead of taking place during an edge. This variant is illustrated in FIG. 5*b* which shows a timing diagram of the hold signal Vref and of the addressing signal Vad superimposed on the hold signal Vref.

This variant is of interest when the line addressing circuits ADL1, ADL2, . . . ADLn are equipped with special chopping means for producing, for example, multiple write pulses. These chopping means are known per se.

The line selected for writing receives the addressing signal Vad superimposed on the hold signal Vref, this being equal to Vref+Vd, the charging of the capacitances c has occurred at the start of the extreme porch Ph of the hold signal Vref during which writing took place. The write pulses are obtained by the chopping means built into the addressing circuits ADT1, ADL2, . . . ADLn. At the termination of the extreme porch, the line selected for erasure can receive the addressing signal Vad superimposed on the hold signal Vref, that is to say Vref+Vd since the capacitances are still charged. The switches T1, T2 of the pair belonging to the module linked to this line merely need to be suitably switched.

The other lines receive only the hold signal Vref by appropriate switching of the pair of switches of the module associated therewith.

When the hold signal Vref reaches the extreme porch Pb which follows that in which writing took place, the switch I1 is off and this causes the discharging or the capacitances c, that is to say the signal portion Vpd with decreasing slope.

Figure 6B:
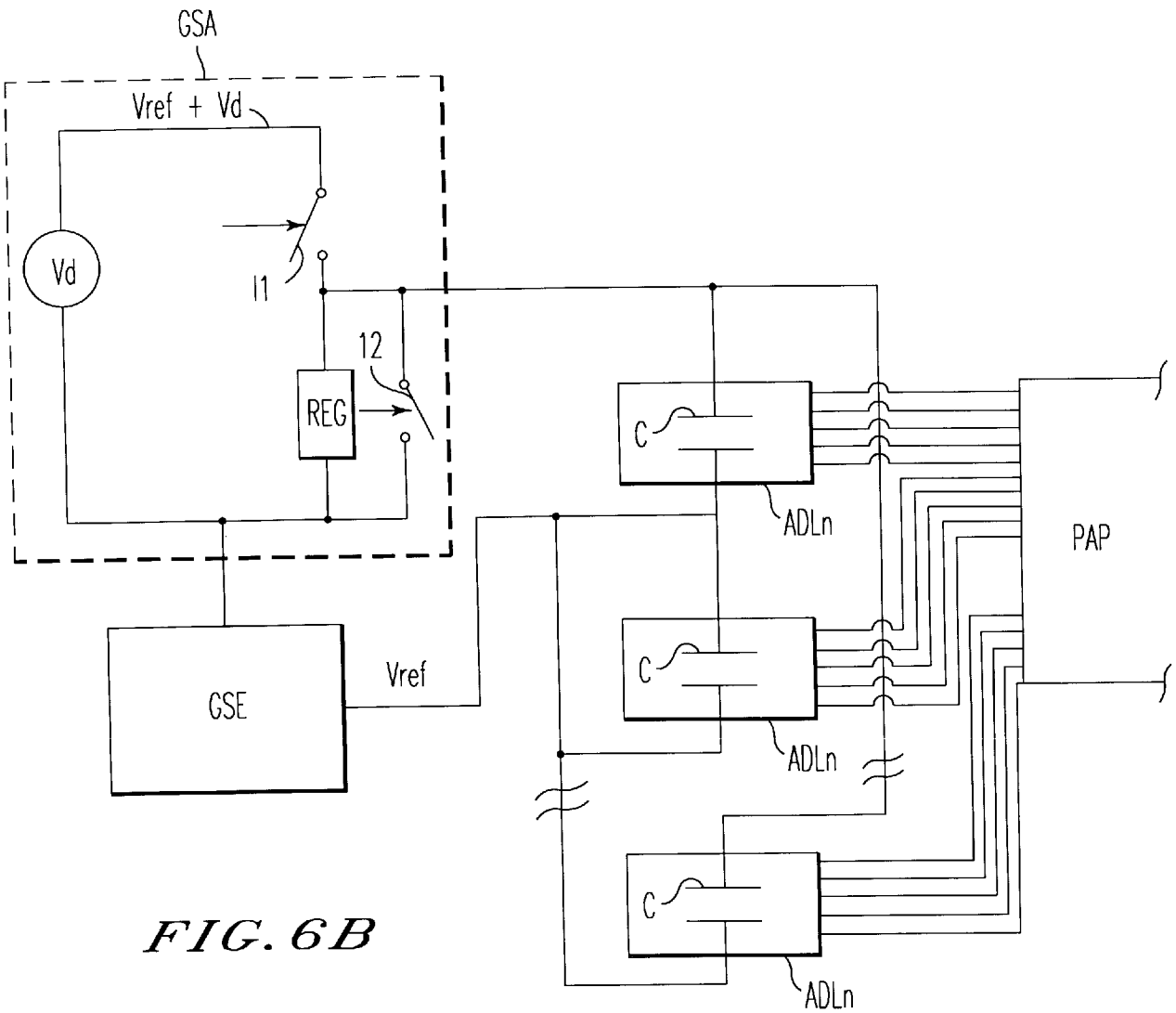

If the line addressing circuits ADL1, . . . ADLn are not equipped with chopping means, it is possible for the circuit GSA which generates the addressing signal Vad superimposed on the hold signal Vref to comprise these chopping means. FIG. 6*b* illustrates this case. A second switch I2 is used. It is mounted in parallel with the current regulation device Peg.

The switch I2 is kept off during erasure but as soon as the capacitances c are charged at the start of the extreme porch of the hold signal Vref, it can be actuated. The write pulses are obtained by switching it on and off alternately.

An advantage of the process according to the invention is that it does not require a hold signal with a middle porch and hence it is possible to dispense with the circuit which generates this middle porch.

What is claimed is:

1. Process for controlling a display panel comprising cells defined by the intersection of two networks of crossed electrodes, these cells possessing two states, one written, the other erased, the process consisting:

in applying a substantially square-wave hold signal on either side of a middle potential to all the cells, with the aim of producing a hold discharge with regard to the cells in the written state, at the termination of the edges leading to an extreme porch, and in applying an addressing signal, superimposed on the hold signal, in succession to the electrodes of a network, this addressing signal comprising a semi-selective erase signal, generating, in respect of the cells in the written state and which are linked to the selected electrode, an erase discharge, characterized in that the erase discharge occurs at the termination of an edge leading to an extreme porch of the hold signal alone, this erase discharge disabling the hold discharge which should have occurred at the termination of this edge leading to the extreme porch of the hold signal alone.

2. Process for controlling a display panel according to claim 1, characterized in that the semi-selective erase addressing signal is a voltage pulse generated from an extreme porch of the hold signal, starting early enough to disable the hold discharge.

3. Process for controlling a display panel according to claim 1, characterized in that the semi-selective erase addressing signal comprises a signal portion with decreasing slope starting at the start of the extreme porch of the hold signal, based on an intermediate potential, referenced with respect to the potential of the extreme porch, lying between the potential of the extreme porch and the middle potential and ending at a residual potential, referenced to the potential of the extreme porch, lying between the potential of the extreme porch and the intermediate potential.

4. Process according to claim 3, characterized in that the signal portion with decreasing slope is preceded by a signal portion which follows the edge leading to the extreme porch of the hold signal offset by the intermediate potential.

5. Control process according to claim 3, the electrodes of a network receiving the hold and addressing signals of one or more addressing circuits which are equivalent to capacitances, characterized in that the signal portion with decreasing slope is obtained by discharging the capacitances.

6. Control process according to claim 5, characterized in that the signal portion with decreasing slope has an adjustable time constant.

7. Control process according to claim 5, characterized in that the charging of the capacitances is performed during the edge leading to the extreme porch of the hold signal.

8. Control process according to claim 5, characterized in that the charging of the capacitances is performed during the extreme porch of the hold signal which precedes that during which the signal portion with decreasing slope takes place.

9. Control process according to claim 8, characterized in that the addressing signal comprises a write-selective signal comprising one or more pulses produced by the charging of the capacitances.

10. Image display device to which the process according to claim 1 is applied, comprising:

a display panel whose cells are situated at the intersection of two crossed networks of electrodes, one or more addressing circuits linked to the electrodes of a network, each circuit comprising an output stage comprising a pair of switches per electrode to which it is linked, one of these switches receiving the hold signal, the other the addressing signal superimposed on the hold signal, a generator of hold signals feeding the addressing circuits, a generator of addressing signals feeding the addressing circuits, characterized in that the switch receiving the hold signal is dimensioned so as to be able to carry the hold discharge current.

11. Display device according to claim 10, characterized in that the generator of addressing signals comprises:

a voltage source referenced with respect to the hold signal, a switch and a current regulation circuit in series, which are connected across the terminals of the voltage source, the switch being connected to the output of the voltage source, the addressing circuits equivalent to capacitances being mounted in parallel with the current regulation circuit, the switch I1 being on in order to charge the capacitances and off in order to discharge them.

12. Display device according to claim 11, characterized in that the generator of addressing signals is equipped with means for producing multiple write pulses.

13. Display device according to claim 12, characterized in that the means for producing the multiple write pulses comprise a switch mounted in parallel with the current regulation circuit.

14. Control process according to claim 4, the electrodes of a network receiving the hold and addressing signals of one or more addressing circuits which are equivalent to capacitances, characterized in that the signal portion with decreasing slope is obtained by discharging the capacitances.

15. Control process according to claim 6, characterized in that the charging of the capacitances is performed during the edge leading to the extreme porch of the hold signal.

16. Control process according to claim 6, characterized in that the charging of the capacitances is performed during the extreme porch of the hold signal which precedes that during which the signal portion with decreasing slope takes place.

17. Image display device to which the process according to claim 2 is applied, comprising:

a display panel whose cells are situated at the intersection of two crossed networks of electrodes, one or more addressing circuits linked to the electrodes of a network, each circuit comprising an output stage comprising a pair of switches per electrode to which it is linked, one of these switches receiving the hold signal, the other the addressing signal superimposed on the hold signal, a generator of hold signals feeding the addressing circuits, a generator of addressing signals feeding the addressing circuits, characterized in that the switch receiving the hold signal is dimensioned so as to be able to carry the hold discharge current.

18. Image display device to which the process according to claim 3 is applied, comprising:

a display panel whose cells are situated at the intersection of two crossed networks of electrodes, one or more addressing circuits linked to the electrodes of a network, each circuit comprising an output stage comprising a pair of switches per electrode to which it is linked, one of these switches receiving the hold signal, the other the addressing signal superimposed on the hold signal, a generator of hold signals feeding the addressing circuits, a generator of addressing signals feeding the addressing circuits, characterized in that the switch receiving the hold signal is dimensioned so as to be able to carry the hold discharge current.

19. Image display device to which the process according to claim 4 is applied, comprising:

a display panel whose cells are situated at the intersection of two crossed networks of electrodes, one or more addressing circuits linked to the electrodes of a network, each circuit comprising an output stage comprising a pair of switches per electrode to which it is linked, one of these switches receiving the hold signal, the other the addressing signal superimposed on the hold signal, a generator of hold signals feeding the addressing circuits, a generator of addressing signals feeding the addressing circuits, characterized in that the switch receiving the hold signal is dimensioned so as to be able to carry the hold discharge current.

20. Image display device to which the process according to claim 5 is applied, comprising:

a display panel whose cells are situated at the intersection of two crossed networks of electrodes, one or more addressing circuits linked to the electrodes of a network, each circuit comprising an output stage comprising a pair of switches per electrode to which it is linked, one of these switches receiving the hold signal, the other the addressing signal superimposed on the hold signal, a generator of hold signals feeding the addressing circuits, a generator of addressing signals feeding the addressing circuits, characterized in that the switch receiving the hold signal is dimensioned so as to be able to carry the hold discharge current.

* * * * *